US005562252A

United States Patent [19]

Dunn

[11] Patent Number: 5,562,252

[45] Date of Patent: Oct. 8, 1996

[54] IN-LINE WATER JET DIFFUSER

[76] Inventor: William H. Dunn, 1202 Ortego Dr., Fairborn, Ohio 45324

[21] Appl. No.: 317,112

[22] Filed: Oct. 3, 1994

[51] Int. Cl.[6] ..... B05B 1/26

[52] U.S. Cl. ..... 239/505; 239/514; 239/516

[58] Field of Search ..... 239/500, 505, 239/507, 512, 514, 516, 558, 222, 222.11, 222.13, 222.17, 233, 228, 380, 382, 383; 169/70, 25

[56] References Cited

U.S. PATENT DOCUMENTS

| | | | |
|---|---|---|---|
| 2,448,472 | 8/1948 | Schott | 239/505 |
| 2,486,137 | 10/1949 | Evans | 239/383 |
| 3,313,353 | 4/1967 | Williamson et al. | 169/1 |
| 4,427,074 | 1/1984 | Wollin | 169/70 |
| 4,700,894 | 10/1984 | Grzych | 239/555 |
| 4,976,319 | 12/1990 | Eberhardt et al. | 169/70 |
| 5,046,564 | 9/1991 | Poulsen | 169/47 |
| 5,062,487 | 11/1991 | Siria et al. | 169/91 |

*Primary Examiner*—Andres Kashnikow
*Assistant Examiner*—Lisa Douglas
*Attorney, Agent, or Firm*—Michael I. Kroll

[57] ABSTRACT

A water cannon jet diffuser including a flexible tether, a diffuser head, an apparatus for storing and paying out the flexible tether, an apparatus for retaining the flexible tether to the cannon barrel, a motor for rewinding a reel, manual controls for controlling the motor, and a brake apparatus for controlling the rate of pay out of the flexible tether.

3 Claims, 4 Drawing Sheets

IN-LINE WATER JET DIFFUSER

BACKGROUND OF THE INVENTION

1. Field of the Invention

The present invention relates to fire fighting. More specifically, it relates to an apparatus for increasing the effectiveness of a water delivery to a flame so as to squelch the combustion in the minimum amount of time. In particular, a rotating diffuser held in a liquid jet by the force of the jet. The novel diffuser redirects and diffuses a jet of water discharged to fight a fire. The diffused water stream is much more effective in removing heat energy from the fire site because of the increased surface area of the water delivered.

2. Description of the Prior Art

It is well recognized in the prior art that a high speed, concentrated jet of water directed at a fire is frequently not effective. Means for diffusing the jet, particularly near the point of application, would be preferable.

Disadvantages of a concentrated, intense jet are discussed in U.S. Pat. No. 3,313,353, issued to Hilding V. Williamson et al. on Apr. 11, 1967. Although directed to a gaseous carbon dioxide stream, some of the same concerns apply to fires being fought with water. This invention includes a nozzle having a generally conical skirt, which is solidly supported at the end of a conduit.

Another diffusing apparatus supported at the end of a rigid member is seen in U.S. Pat. No. 4,700,894, issued to Leo J. Grzych on Oct., 20, 1987. Grzych '894 discloses a nozzle assembly for shaping and diffusing a water jet for fire fighting. The nozzle assembly is supported at the end of an elongated handle so that it can be positioned proximate to a fire while being held at a distance by a fire fighter.

Another approach to delivering a diffused stream of water is to pressurize an air stream, and using the air stream to transport and diffuse the water jet. Examples are shown in U.S. Pat. No. 5,046,564, issued to Thomas E. Poulsen on Sep. 10, 1991, and U.S. Pat. No. 5,062,487, issued to Darrell L. Siria et al. on Nov. 5, 1991.

Poulsen '564 discloses a system for transporting and dispersing a water stream so that it will carry farther. A jet engine or the like discharges a high speed exhaust stream which is used to carry and diffuse a water jet. This is useful in fighting fires in rough terrain, where ordinary fire fighting equipment is hampered by lack of mobility.

Siria et al. '487 discloses a self-standing assembly including air propulsion means in the form of a propeller; an engine powering the propeller; water nozzle means for delivering water under constant conditions of pressure and flow rate; and a frame for supporting the other components. A cooled air stream cools the environment of the fire, enabling fire fighters to approach the fire, and assess fire fighting strategies.

None of the above inventions and patents, taken either singly or in combination, is seen to describe the instant invention as claimed.

SUMMARY OF THE INVENTION

The present invention enables a conventional water cannon to be provided with the benefits of water diffusion. A floating diffuser head is tethered to the cannon barrel, and is supported in the air ahead of and above the cannon barrel by the water jet. The diffuser head has two fan assemblies, one for intercepting the jet and maintaining the diffuser head supported thereby, and the other for diffusing the water stream.

The fan assemblies are arranged in line, and are rotatably mounted on a common axial shaft. The fan assemblies have oppositely pitched blades to assure counter-rotation. The blades are perforated, in order to allow diffused water to pass therethrough. The first fan reacts to the water jet so as to transfer momentum therefrom to the diffuser head, thus supporting the diffuser head in the air, above and ahead of the water cannon. The second fan disperses the water so that it will fall from the diffuser head in the area proximate thereto.

Tether line is payed out from the reel by the force of the water jet bearing against the diffuser head. A hand brake controls the rate of line payout. A motor is provided to reel in tether line and thus retrieve the diffuser head.

A number of benefits accrue from providing a diffuser to a conventional water cannon. A diffused stream of water can cool a larger local area of a fire than can a concentrated jet. The diffused water presents a much larger surface area to the superheated air near the fire. Heat is removed from the area by the evaporation of the water and the production of steam. The evaporation is facilitated by the diffuser to the extent that almost all the water presented to the site will be quickly changed to steam, thus removing the maximum amount of heat from the fire as quickly as possible.

Also, there are certain recurrent situations in which a diffuser provides abilities beyond the reach of a plain high powered jet. One example of this latter benefit is fighting a fire in a room in a building, where there is limited access to the room. A relatively small diffuser head can be maneuvered into the room, as by through a window or doorway. The diffuser, which is of heat resistant construction, and is also self-cooling in that it sits in the stream of water, is then located in the inaccessible room, and diffuses water. This has the result of enabling the water to "turn the corner", or propagate laterally. A linear jet cannot be assured of achieving the same result merely by splashing against a convenient environmental surface. This may extinguish, or abater a fire in a location inaccessible to fire fighting personnel.

Accordingly, it is a principal object of the invention to provide apparatus for use with a water cannon which will diffuse the water jet.

It is a further object of the invention to provide a water diffuser for a water cannon which is supported by the jet of water issuing from the cannon.

It is another object of the invention to provide a water diffuser for a water cannon which is adjustably located, with respect to proximity to the mouth of the water cannon.

Still another object of the invention is to provide manual adjustment of proximity of the water diffuser with respect to proximity to the mouth of the water cannon.

A still further object of the invention is to provide manual control over the rate of tether line pay out.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
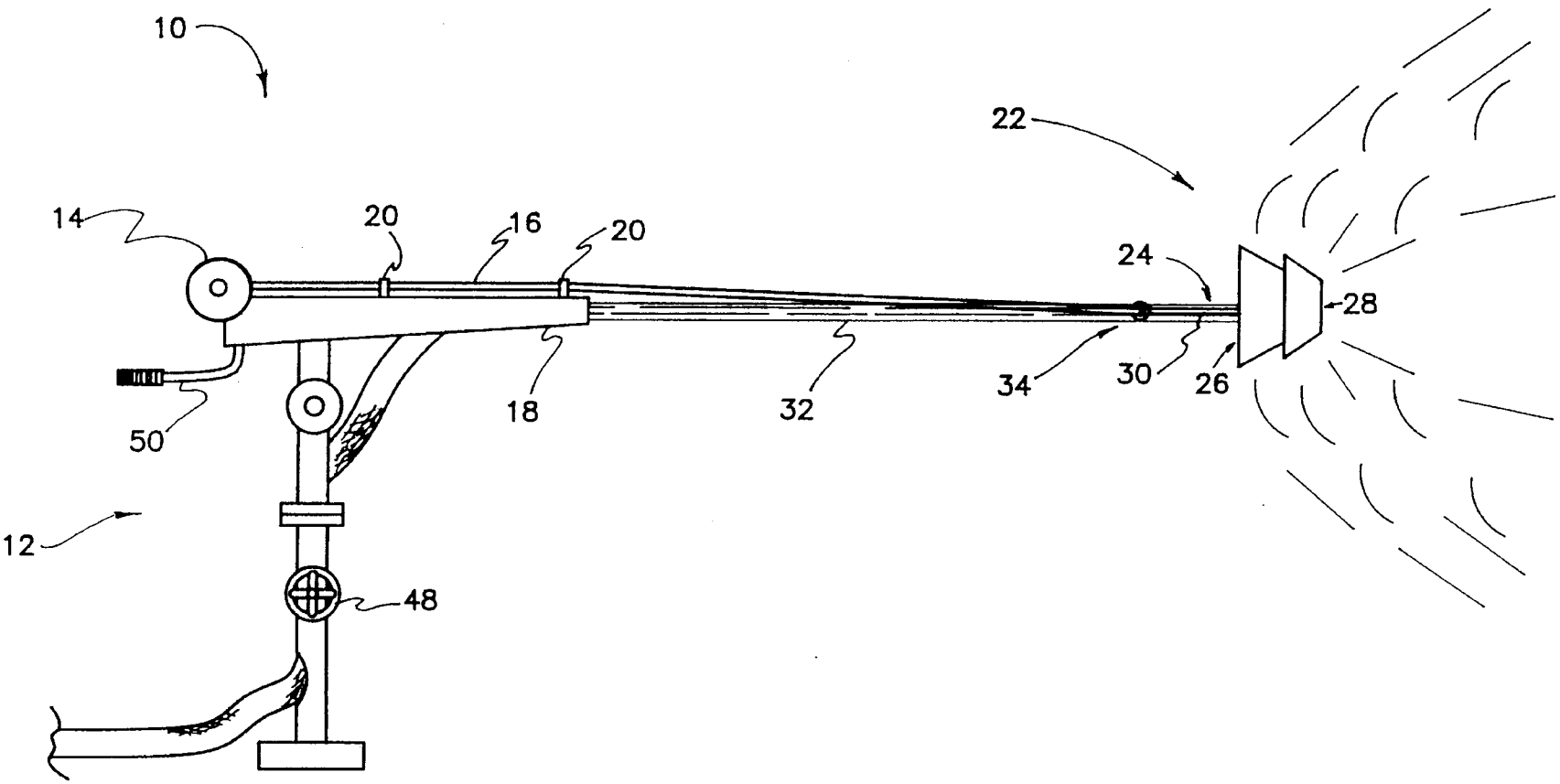
FIG. 1 is an environmental, side elevational view of the invention.

Throughout this specification, the following reference numerals are employed to refer to the following elements.

| | |
|---|---|
| 10 | diffuser |
| 12 | water cannon |
| 14 | reel |
| 16 | tethering line |
| 18 | (cannon) barrel |
| 20 | eyes |
| 22 | diffuser head |
| 24 | shaft |
| 26 | first fan |
| 28 | second fan |
| 30 | exposed section |
| 32 | water jet |
| 34 | free turning swivel |
| 36 | bearings |
| 38 | blades (first fan) |
| 40 | perforations |
| 42 | baffle (second fan) |
| 44 | blades (second fan) |
| 46 | perforations (second fan) |
| 48 | control wheel |
| 50 | handle |
| 52 | motor |
| 54 | pushbuttons |
| 58 | hand brake |
| 60 | handle |
| 62 | brake shoe |
| 64 | drum |

Turning now to FIG. 1, the novel water jet diffuser 10 is seen incorporated into a conventional water cannon 12 for fighting fires (not shown). A reel 14 is mounted to the back of the water cannon 12, and stores and pays out a tethering line 16. This tethering line 16 passes along the barrel 18 of the water cannon 12, retained therealong by eyes 20 or the like, extending to a diffuser head 22.

The diffuser head 22 includes a shaft 24 which rotatably supports two fans 26,28. The shaft 24 has an exposed section 30 extending between the point of attachment to the tethering line 16 and the first fan 26. This section 30 helps stabilize the diffuser head 22 as it is supported in the water jet 32. The tethering line 16 attaches to a free turning swivel 34 located at the proximal end of shaft 24. Swivel 34 accommodates various torques and motions experienced by diffuser head 22 in response to the various forces imposed thereon.

Figure 2:
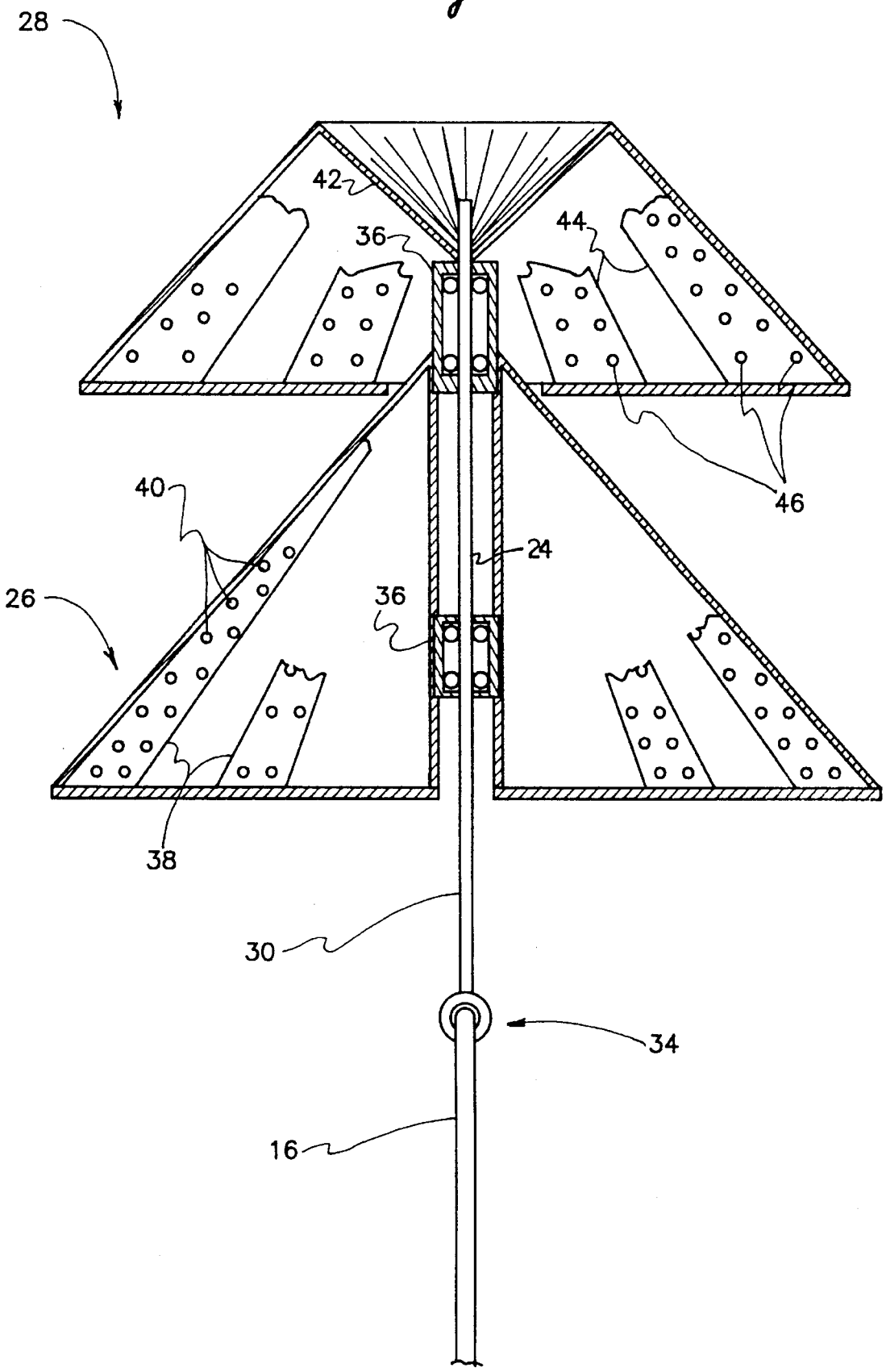
FIG. 2 is a side cross sectional detail view of the diffuser head.

Both fans 26 and 28 are frustoconical, as seen in FIG. 2. Each fan 26 or 28 is mounted on a respective bearing 36 or 36 disposed upon shaft 24. As viewed from an end (not shown, but as may be understood from FIG. 2), the first fan 26 has about half its frontal area unencumbered by fan blades. That portion of frontal area accounted for by fan blades 38 is relieved by perforations 40, enabling water to pass on to the next fan 28.

The second fan 28 is made in two parts. A first section comprises a conical baffle 42 which redirects the water Jet laterally. This conical baffle 42 prevents water from passing ineffectually through the diffuser head 22, and causes the water to exit multidirectionally therefrom. Therefore, the location of the diffuser head, with respect to distance from the mouth of the water cannon 12, determines the point at which water is diffused and redirected against a fire (not shown).

Small blades 44 disposed upon the second fan 28 complete the diffusion action to the impinging water jet 32 (see FIG. 1), which would be less uniform, and possibly still in the form of concentrated jets or streams, if water contacted only the conical baffle 42. These small blades 44 also include perforations 46, enabling water to pass through the second fan 28 and be distributed substantially uniformly.

Blades 38 and 44 are disposed at a pitch, relative to the impinging water jet, so that a component of force of the impinging water strikes the diffuser head 22 at an angle. This enables the diffuser head 22 to react to the water jet 32 and derive support therefrom. This is similar to the manner in which a kite becomes airborne in response to wind. The pitch of each fan 26 or 28 ensures that each respective fan 26 or 28 rotates in response to water flow. The pitch of the two sets of fan blades 38,44 is opposite, so that the two fans 26,28 are caused to counter-rotate.

In a preferred method of use, the diffuser head 22 is initially located at the mouth of the water cannon 12. A water valve, indicated by control wheel 48 (see FIG. 1), is opened, and pressurized water issues from the water cannon 12, lifting the diffuser head 22. The tethering line 16 pays out responsive to pressure bearing against diffuser head 22. As will be explained further hereinafter, pay out is manually controlled at brake handle 60 (see FIG. 4) until the diffuser head 22 is located as desired by fire fighting personnel. When the fire is under control, the diffuser head 22 is retrieved under power, also explained hereinafter. When the diffuser head 22 is returned to its initial position, water is shut off. The diffuser head 22 is also stowed in the initial position, so as to be prepared for immediate deployment.

Figure 3:
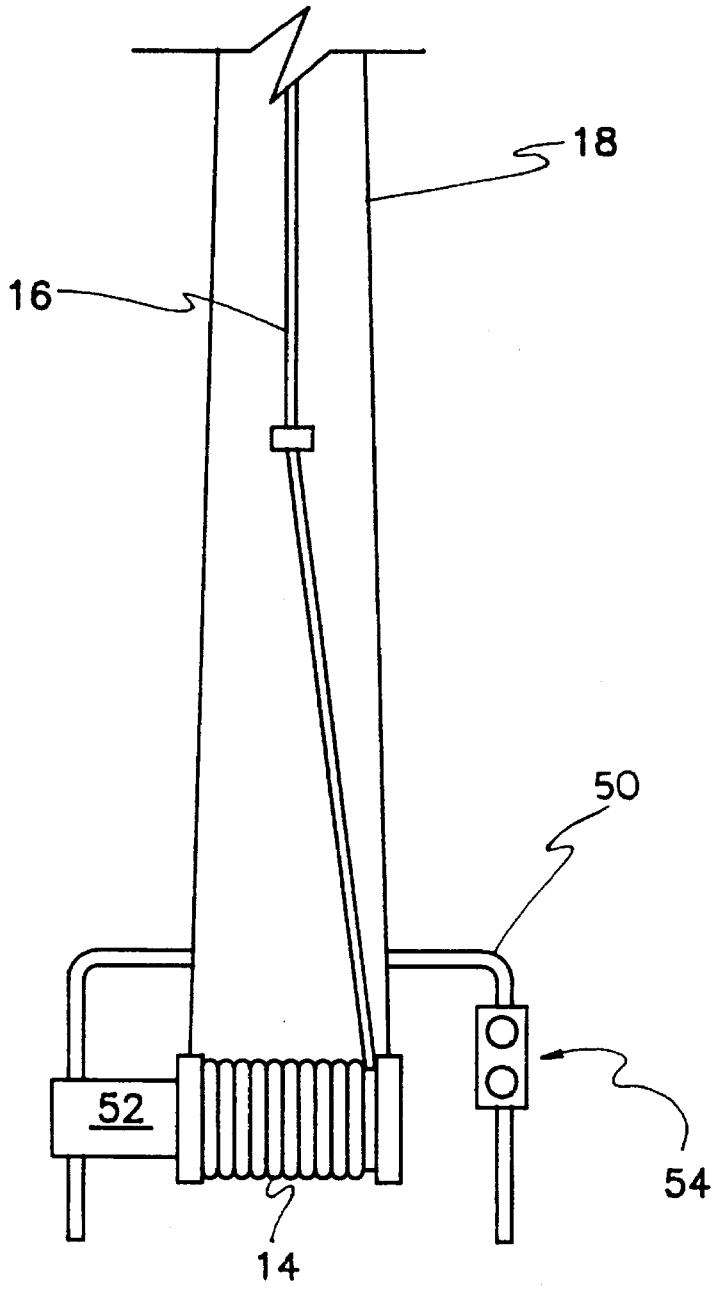
FIG. 3 is a fragmentary, top plan environmental view of an alternate embodiment of the invention, wherein the reel is motorized.

As shown in FIG. 3, reel 14 is rewound by a motor 52 which is controlled by pushbuttons 54. Pushbuttons 54 are preferably mounted on maneuvering handle 50 affixed to cannon barrel 18 for the conventional maneuvering and control of water cannon 12.

Figure 4:
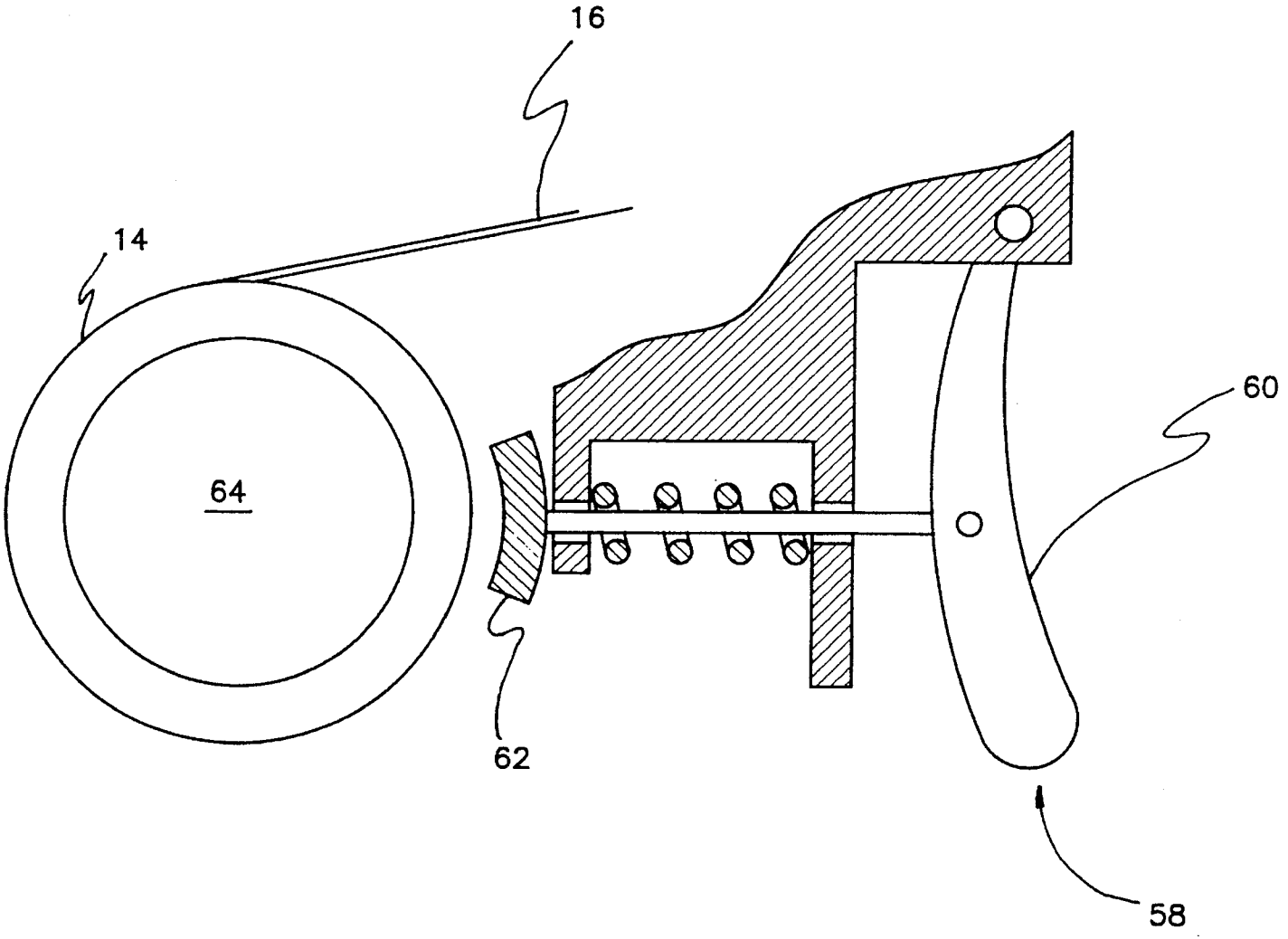
FIG. 4 is a cross sectional, side elevational detail view of the line brake.

Another feature of the water diffuser 10 is seen in FIG. 4. A hand brake 58 is grasped to slow the rate of pay out of tethering line 16. Hand brake 58 includes a pivotally mounted handle 60 connected to a brake shoe 62. Brake shoe 62 bears against a rotating drum 64 which is part of reel 14, and is spring biased to return to the released position. Hand brake 58 is preferrably mounted at any convenient point on water cannon 12 proximate to the path of tethering line 16 as it is paid out.

The invention is also practiced by employing plural water diffusers 10. A large or unusually hot fire is surrounded by several water cannons 12 each equipped with a novel diffuser 10, so that all air entering the vicinity is cooled, and the entire affected area is inundated with a diffused spray from all directions.

It is to be understood that the present invention is not limited to the sole embodiment described above, but encompasses any and all embodiments within the scope of the following claims.

I claim:

1. A water cannon jet diffuser, comprising:

a flexible tether having proximal and distal ends, said proximal end being attached to the water cannon; and a diffuser head attached to said tether distal end and including mean for holding said diffuser head supported in the air in front of said water cannon by the force of water issuing from said water cannon, said diffuser head comprising first and second rotating fans, and means causing said first and second rotating fans to counter-rotate, said diffuser head further including a conical member for redirecting water passing therethrough so as to exit said diffuser head multidirectionally, whereby the location of said diffuser head determines the point at which the water cannon water jet is redirected against a fire, said first and second rotating fans each have blades including means defining perforations therethrough, whereby water passes through said blades, and is distributed substantially uniformly;

means for storing and paying out said flexible tether, said means for storing and paying out said flexible tether comprising a reel controllably attached to the water cannon, whereby said flexible tether is paid out by a person using said water cannon and said water diffusing apparatus, and said diffuser head is supported at a desired proximity to said water cannon;

means for retaining said flexible tether to the cannon barrel;

a motor for rewinding said reel;

manual controls for controlling said motor; and brake means for controlling the rate of out of said flexible tether, said brake means having manual control means for slowing the rate of pay out of said flexible tether.

2. A water cannon jet diffuser, comprising:

a flexible tether having proximal and distal ends, said proximal end being attached to the water cannon;

means for storing and paying out said flexible tether, comprising a reel attached to the water cannon, said reel having a handle, whereby said flexible tether is selectively paid out and reeled in by a person using said water cannon and said water diffusing apparatus, and a diffuser head is supported at a desired proximity to said water cannon;

means for retaining said flexible tether to the cannon barrel;

brake means for controlling the rate of pay out of said flexible tether; and a diffuser head attached to said flexible tether distal end and including means for holding said diffuser head supported in the air in front of said water cannon by the force of water issuing from said water cannon, said diffuser head comprising first and second rotating fans each having blades including means defining perforations therethrough, whereby water passes through said blades, and is distributed substantially uniformly, and means causing said rotating fans to counter-rotate, and a conical member for redirecting water passing therethrough so as to exit said diffuser head multidirectionally, whereby the location of said diffuser head determines the point at which the water cannon water jet is redirected against a fire.

3. A water cannon jet diffuser, comprising:

a flexible tether having proximal and distal ends, said proximal end being attached to the water cannon;

means for storing and paying out said flexible tether, comprising a reel attached to the water cannon, said reel having a handle, whereby said flexible tether is selectively paid out and reeled in by a person using said water cannon and said water diffusing apparatus, and a diffuser head is supported at a desired proximity to said water cannon;

a motor mounted on said water diffusing apparatus and connected to said reel for rewinding said reel;

manual controls mounted on said water diffusing apparatus and connected to said motor, for controlling said motor;

means for retaining said flexible tether to the cannon barrel;

brake means for controlling the rate of pay out of said flexible tether; and a diffuser head attached to said flexible tether distal end and including means for holding said diffuser head supported in the air in front of said water cannon by the force of water issuing from said water cannon, said diffuser head comprising first and second rotating fans each having blades including means defining perforations therethrough, whereby water passes through said blades, and is distributed substantially uniformly, and means causing said rotating fans to counter-rotate, and a conical member for redirecting water passing therethrough so as to exit said diffuser head multidirectionally, whereby the location of said diffuser head determines the point at which the water cannon water jet is redirected against a fire.

* * * * *